US010865664B2

(12) United States Patent
Smerczak

(10) Patent No.: US 10,865,664 B2
(45) Date of Patent: Dec. 15, 2020

(54) CAM PHASER CAMSHAFT COUPLING

(71) Applicant: BorgWarner Inc., Auburn Hills, MI (US)

(72) Inventor: John R. Smerczak, Ortonville, MI (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 16/666,477

(22) Filed: Oct. 29, 2019

(65) Prior Publication Data

US 2020/0141285 A1 May 7, 2020

Related U.S. Application Data

(60) Provisional application No. 62/754,003, filed on Nov. 1, 2018.

(51) Int. Cl.
*F01L 1/14* (2006.01)
*F01L 1/344* (2006.01)

(52) U.S. Cl.
CPC ..... *F01L 1/143* (2013.01); *F01L 1/3442* (2013.01)

(58) Field of Classification Search
CPC . F01L 2001/0473; F01L 1/053; F01L 1/3442; F01L 2001/34426; F01L 2001/34433; F01L 2001/3445; F01L 1/46
USPC ..... 123/90.15, 90.17, 90.27
See application file for complete search history.

(56) References Cited

U.S. PATENT DOCUMENTS

| | | | |
|---|---|---|---|
| 5,161,493 | A | 11/1992 | Ma |
| 6,725,817 | B2 | 4/2004 | Methley et al. |
| 6,928,971 | B2 | 8/2005 | Knecht et al. |
| 7,284,517 | B2 | 10/2007 | Lancefield et al. |
| 7,506,623 | B2 | 3/2009 | Schafer et al. |
| 7,765,967 | B2 | 8/2010 | Kira |
| 8,051,818 | B2 | 11/2011 | Myers et al. |
| 8,113,159 | B2 | 2/2012 | Myers et al. |
| 8,187,106 | B2 | 5/2012 | Muenich et al. |
| 8,201,528 | B2 | 6/2012 | Knecht et al. |
| 8,336,512 | B2 | 12/2012 | Myers et al. |
| 8,375,906 | B2 | 2/2013 | Myers et al. |
| 8,459,220 | B2 | 6/2013 | Comello |
| 8,689,755 | B2 | 4/2014 | Schneider et al. |
| 9,797,278 | B2 | 10/2017 | Flender et al. |

(Continued)

FOREIGN PATENT DOCUMENTS

| | | | |
|---|---|---|---|
| JP | 2001263025 | A | 9/2001 |
| WO | 2007116294 | A2 | 10/2007 |

*Primary Examiner* — Jorge L Leon, Jr.
(74) *Attorney, Agent, or Firm* — Reising Ethington P.C.

(57) ABSTRACT

A hydraulically-actuated camshaft phaser includes a camshaft sprocket having a plurality of teeth configured to engage an endless loop that transmits angular motion from the crankshaft to the hydraulically-actuated camshaft phaser; a rotor, coupled with the camshaft sprocket to prevent angular movement between the camshaft sprocket and the rotor, that includes one or more vanes extending radially outwardly forming a plurality of fluid chambers; and a housing that selectively changes angular position relative to the rotor and the crankshaft and is configured to be linked with a variable phase camshaft to change the angular position of the variable phase camshaft relative to the crankshaft.

15 Claims, 5 Drawing Sheets

(56) References Cited

U.S. PATENT DOCUMENTS

| | | | | |
|---|---|---|---|---|
| 2013/0199470 | A1* | 8/2013 | Schafer | F01L 1/3442 123/90.15 |
| 2015/0176442 | A1 | 6/2015 | Kwak et al. | |
| 2017/0138228 | A1 | 5/2017 | Miyachi et al. | |
| 2017/0159512 | A1 | 6/2017 | Flender et al. | |
| 2017/0159791 | A1 | 6/2017 | Flender et al. | |
| 2018/0030862 | A1 | 2/2018 | Weber et al. | |
| 2018/0073655 | A1 | 3/2018 | Miyachi et al. | |
| 2018/0087410 | A1 | 3/2018 | Cecil | |
| 2019/0153907 | A1* | 5/2019 | Pawade | F01L 1/344 |

* cited by examiner

CAM PHASER CAMSHAFT COUPLING

CROSS-REFERENCE TO RELATED APPLICATIONS

This application claims the benefit of U.S. Patent Application No. 62/754,003 filed on Nov. 1, 2018, the disclosure of which is herein incorporated by reference in its entirety.

TECHNICAL FIELD

The present application relates to internal combustion engines and, more particularly, to variable camshaft timing used with internal combustion engines.

BACKGROUND

Internal combustion engines (ICE) open and close valves as part of the combustion process. Typically, one or more camshafts are rotationally coupled with a crankshaft via an endless loop that transmits rotational force from the crankshaft to the camshaft(s). In the past, the angular position of the crankshaft relative to the camshaft(s) has been fixed. But more recently, variable camshaft timing in the form of camshaft phasers (or simply a "cam phaser") has been used to vary or alter the angular position of the camshafts relative to the crankshaft. Depending on a variety of factors, engine operation can be optimized by changing, either advancing or retarding, the angular position of the camshaft(s) relative to the crankshaft. This can also be referred to as changing the phase of the camshaft(s). One portion of the camshaft phaser includes a camshaft sprocket rotationally coupled to the crankshaft via the endless loop and another portion of the camshaft phaser is coupled to the camshaft. The camshaft phaser can change an angular position of one portion of the camshaft phaser relative to another portion of the camshaft phaser in a variety of different ways. For example, the camshaft phaser can be hydraulically-controlled such that a hub with one or more vanes is angularly, displaced by a fluid to advance or retard timing.

But implementing variable camshaft timing on engines using camshaft phasers involves a number of challenges. ICEs sometimes use hydraulically-actuated camshaft phasers that include a rotor and a stator. Typically, the rotor is mechanically coupled with the camshaft and the stator includes a plurality of radially-outwardly facing teeth that engage an endless loop connected with a crankshaft. The endless loop can communicate the angular motion from the crankshaft to the stator such that the angular position of the stator is fixed relative to the crankshaft. The rotor can be angularly displaced relative to the stator thereby changing the angular position of the camshaft with respect to the crankshaft. However, hydraulically-actuated camshaft phasers can be configured differently in an effort to reduce the axial length of the phaser or increase tolerance of torsional loads exerted on the phaser from the endless loop through a camshaft sprocket attached to the phaser. Past assemblies of a variable camshaft timing (VCT) device (e.g., a camshaft phaser) couple a rotor to a camshaft and a stator or housing with the crankshaft via an endless loop. However, designs that couple the rotor to the camshaft can involve a certain level of complexity. For example, the camshaft as it is coupled with the rotor, can extend through the stator using a seal to prevent hydraulic fluid from escaping. It would be simpler to configure a camshaft phaser that did not use a seal between the camshaft and the housing.

SUMMARY

In one embodiment, a hydraulically-actuated camshaft phaser includes a camshaft sprocket having a plurality of teeth configured to engage an endless loop that transmits angular motion from the crankshaft to the hydraulically-actuated camshaft phaser; a rotor, coupled with the camshaft sprocket to prevent angular movement between the camshaft sprocket and the rotor, that includes one or more vanes extending radially outwardly forming a plurality of fluid chambers; and a housing that selectively changes angular position relative to the rotor and is configured to be linked with a variable phase camshaft to change the angular position of the variable phase camshaft relative to the crankshaft.

In another embodiment, a hydraulically-actuated camshaft phaser includes a camshaft sprocket having a plurality of teeth configured to engage an endless loop that transmits angular motion from the crankshaft to the hydraulically-actuated camshaft phaser; a rotor, coupled with the camshaft sprocket to prevent angular movement between the camshaft sprocket and the rotor, that includes one or more vanes extending radially outwardly forming a plurality of fluid chambers; and a housing that selectively changes angular position relative to the rotor and is configured to indirectly link the housing with a variable phase camshaft to change the angular position of the variable phase camshaft relative to the crankshaft.

DETAILED DESCRIPTION

A VCT assembly including a hydraulically-actuated camshaft phaser is used to selectively change a relative angular position of a camshaft of an internal combustion engine (ICE). The hydraulically-actuated camshaft phaser can include a rotor that is linked with the crankshaft of the ICE and a housing that is coupled with an angularly adjustable camshaft of the ICE (also called a variable phase camshaft). The hydraulically-actuated camshaft phaser can include a rotor having one or more vanes that radially-extend from a hub and a housing with a cavity that receives the rotor and vanes. The cavity is sized and shaped to permit the housing to move angularly with respect to the rotor and to form fluid chambers on opposite sides of each vane. The application of pressurized fluid to the fluid chamber(s) on one side of the vane(s) angularly displaces the housing relative to the rotor in a first angular direction while the application of pressurized fluid on an opposite side of the vane(s) causes the housing to move in a second angular direction. The rotor is mechanically linked to a camshaft sprocket having radially-outwardly facing teeth. An endless loop, such as a chain, engages the teeth of the camshaft sprocket as well as radially-outwardly facing teeth of a crankshaft sprocket thereby communicating the rotational motion of the crankshaft to the rotor of the camshaft phaser. The housing can engage the camshaft to be phased, either directly or indirectly, and translate the angular adjustment of the housing relative to the rotor to the camshaft. In one implementation, the housing can be directly coupled with the camshaft via a mechanical link. However, the housing could be indirectly linked with a camshaft that is angularly adjusted relative to the crankshaft by one or more gears. This will be discussed in more detail below.

Implementations in which the hydraulically-actuated camshaft phaser is driven by a timing belt located in an area that is sealed from engine oil use sealed phasers to keep the oil from getting out of the phaser into the oil-free timing drive. If the belt and sprocket have been isolated from oil, and the phaser is mounted inside of the seal and first cam bearing such that the phaser is exposed to oil, the phaser would not need additional sealing to prevent external leakage since it is located in an oil friendly environment along with the cams and valvetrain.

Figure 1:
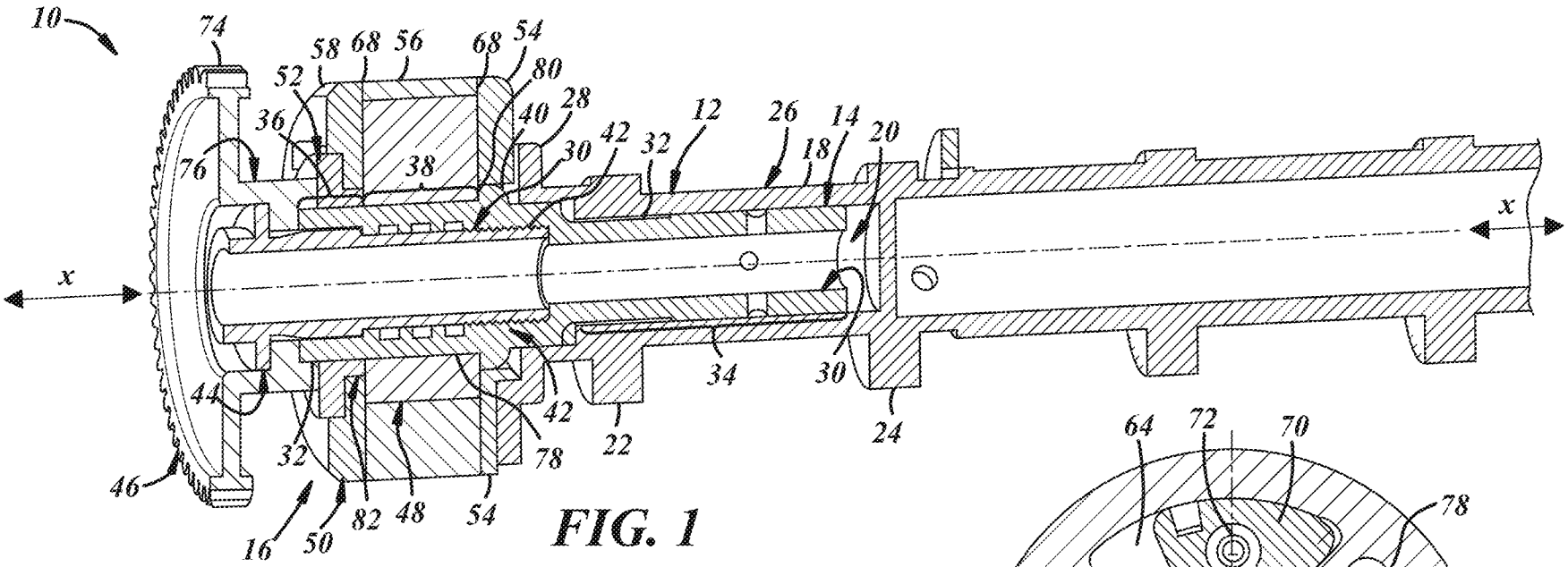
FIG. 1 is a perspective cross-sectional view depicting an implementation of a variable camshaft timing assembly and a camshaft.

Turning to FIG. 1, an implementation of a VCT assembly 10 used in an internal combustion engine (ICE) is shown together with a camshaft 12 in a perspective cross-sectional view. In this implementation, the VCT assembly includes a rotor directly coupled with a camshaft sprocket and a housing that is directly coupled with a camshaft formed from a plurality of elements. The VCT assembly 10 in this implementation includes an elongated camshaft sleeve and all or some portion of a hydraulically-controlled camshaft phaser. Elements of the hydraulically-controlled camshaft phaser can be assembled together with the elongated camshaft sleeve and installed in an ICE to prevent tipping or pivoting about the end camshaft bearing and unwanted binding. The elongated camshaft sleeve has a substantially annular outer surface, an inner cavity having a substantially annular inwardly-facing surface extending a length of the sleeve to be concentric with an end bearing and a distal bearing, and a shoulder extending radially outwardly from the outer surface of the sleeve. The outer surface of the camshaft sleeve can be configured to slidably receive the hub and vanes of a camshaft phaser so that an end surface of the hub engages with the shoulder to not only prevent axial movement between the sleeve and the hub/vanes but rotational movement as well. When the hub engages with the shoulder, an end bearing section, a distal bearing section, and a camshaft receiving section are exposed on the outer surface of the camshaft sleeve. A camshaft sprocket having an end bearing outer surface functioning as an end bearing of the camshaft can be coupled to an end of the camshaft sleeve that is proximate to the end bearing section. The angular position of the camshaft sprocket can then be maintained relative to the angular position of the camshaft sleeve. A retaining device can engage with the camshaft sleeve to axially inhibit movement of the hub and the camshaft sprocket with respect to the camshaft sleeve.

The VCT assembly, including the camshaft sleeve, the hub, and the camshaft sprocket can be combined with a camshaft. An end of the camshaft sleeve opposite to the camshaft sprocket can be slidably received by a hollow cavity within the camshaft. A cam phaser housing can be fixedly attached to the camshaft sleeve and the hub may be received within the cam phaser housing. The VCT assembly can include one section of the camshaft sleeve included with the camshaft sprocket supporting the end bearing and another section of the camshaft sleeve supporting a camshaft bearing distal to the end bearing and included with the camshaft. The hydraulically-controlled camshaft phaser may then be located axially in between the end camshaft bearing and another camshaft bearing located distal to the end camshaft bearing. The camshaft phaser sleeve can support the camshaft at both the end camshaft bearing as well as the distal camshaft bearing at axial positions along the sleeve that are concentric with and radially-inward from the end camshaft bearing and the distal camshaft bearing. The camshaft phaser sleeve then provides support for the camshaft and prevents the camshaft and/or the phaser from pivoting or tipping about the end bearing.

The VCT assembly 10 in this implementation includes a camshaft sleeve 14 and a hydraulically-controlled camshaft phaser 16. The camshaft 12 has an outer surface 18 and an inner cavity 20 open at least one end having a substantially annularly-shaped surface that faces radially inwardly. The outer surface 18 of the camshaft 12 includes a first lobe 22, a second lobe 24, a distal bearing surface 26, and a camshaft shoulder 28. The first lobe 22 and second lobe 24 act on valve stems (not shown) connected to valves to momentarily bias the valves open against the force of a valve spring as the camshaft 12 rotates. The camshaft shoulder 28 can be an annular flange fixedly attached to an end of the camshaft 12 proximate the inner cavity 20. The shoulder 28 can be implemented as an asymmetrically-shaped flange with one flange portion extending further from a center axis (x) relative to another flange portion. The inner cavity 20 can include an axial length having one diameter and another axial length nearer the camshaft sleeve 14 having a larger diameter. The transition between the smaller and larger diameters can prevent the axial movement of the camshaft sleeve 14 relative to the camshaft 12.

The camshaft sleeve 14 includes a substantially annular inner surface 30 and a substantially annular outer surface 32. The outer surface 32 includes a distal bearing section 34, an end bearing section 36, and a hub section 38. When the camshaft sleeve 14 is received by the inner cavity 20 of the camshaft 12, the distal bearing section 34 is positioned radially-inwardly from and concentric with the distal bearing surface 26 of the camshaft 12. The end bearing section 36 is axially spaced from the distal bearing section 34 and positioned radially-inwardly from and concentric with an end bearing of the camshaft 12 when the camshaft sleeve 14 is received by the inner cavity 20 of the camshaft 12. In this implementation, the distal bearing section 34 has a different outer diameter than the end bearing section 36. The transition between the diameter of the distal bearing section 34 and the end bearing section 36 can engage the transition between the smaller and larger diameters of the inner cavity 20 of the camshaft 12 to prevent the axial movement of the camshaft 12 relative to the camshaft sleeve 14. A sleeve shoulder 40 can extend radially outwardly from the outer surface 18 of the camshaft sleeve 14. More specifically, the sleeve shoulder 40 can be a flange that abuts a hub of the hydraulically controlled camshaft phaser 10. This will be discussed in more detail below.

The inner surface 30 of the camshaft sleeve 14 includes one or more securing features 42 that engage a retention device 44 to secure a camshaft sprocket 46 to an end of the sleeve 14 and also prevent axial movement of a plurality of elements of the VCT assembly 10. In this implementation, the securing feature 42 is a set of threads that engage with corresponding threads on the retention device 44. The retention device 44 can be a hollow bolt that extends along a length of the camshaft sleeve 14 of the inner cavity having the larger diameter. An end of the hollow bolt can abut or engage the transition between the smaller and larger diameters of the inner cavity when the VCT assembly 10 is assembled. One or more annular grooves can encircle or at least partially encircle the inner surface 30 of the camshaft sleeve 14 and communicate fluid to a spool valve (not shown). In this implementation, the hydraulically-controlled camshaft phaser 16 can use a cam-torque assisted design in which one groove is used to supply oil to the phaser, another groove is used to selectively communicate oil to an advance chamber of the phaser, and yet another groove is used to selectively communicate oil to a retarding chamber of the phaser. The spool valve can axially slide into the hollow portion of the bolt to control advancing or retarding camshaft phase. A spool valve can selectively move along the x axis to direct fluid through one or more of the grooves while preventing the flow of fluid to another groove. While the spool valve in this embodiment is shown to be located concentric and radially-inward relative to the retention feature 44, other implementations are possible in which a valve controlling the hydraulically-controlled phaser 16 is located remotely from the VCT assembly 10.

The hydraulically-controlled camshaft phaser 16 includes a hub 48 with one or more vanes, a housing 50 that receives the hub 48 and vanes, a thrust plate 52, and a camshaft sprocket 46. The housing 50 can be assembled from an end plate 54, an outer housing 56, and a front plate 58. The end plate 54 can be a flange that fixedly attaches to the camshaft shoulder 28 so that the end plate 54 and the camshaft 12 rotate together. In this implementation, the housing 50 is directly connected to the camshaft 12 via the camshaft shoulder 28. The end plate 54 can have an inner diameter and an outer diameter. The inner diameter of the endplate 54 can be sized to closely conform to an outside surface 32 of the camshaft sleeve 14. In this implementation, the inner diameter is concentric with and closely conforms to a radially outwardly extending surface of the sleeve shoulder 40. The outer housing 56 can be annularly shaped such that it has an axial length extending along the x-axis that is longer than an axial length of the hub 48 along the x-axis.

The front plate 58 can be a flange with an inner diameter and an outer diameter. The inner diameter can be sized to allow the camshaft sleeve 14 to pass through while the outer diameter is sized to abut an end of the outer housing 56 of the housing 50. At each end 68, the outer housing 56 can include locating features, such as slots or pins, that engage with recessed features in the front plate 58 and end plate 54 to rigidly secure the front plate 58, outer housing 56, and end plate 54 together to form the housing 50. In some implementations, a thrust plate 52 can be included so that it abuts the front plate 58. The thrust plate 52 can include an inner diameter that is sized to allow the camshaft sleeve 14 to pass through it. It should be appreciated that this is one implementation of a hydraulically-controlled camshaft phaser 16 and that other implementations including fewer or additional elements are possible. The VCT assembly 10 can be implemented using either oil-pressure actuated or cam-torque actuated variable camshaft phasers.

Figure 2:
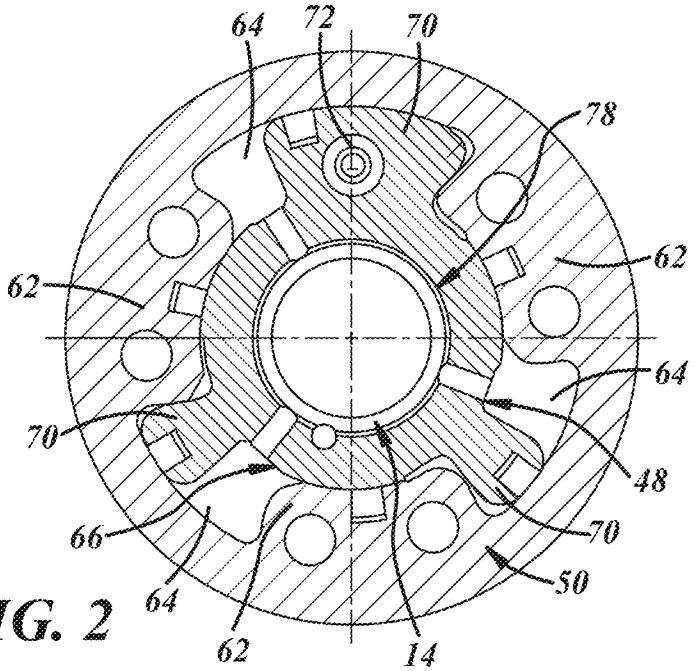
FIG. 2 is a profile cross-sectional view depicting a portion of a variable camshaft timing assembly.

A cross section of the hub 48 and housing 50 is shown in FIG. 2 as these elements fit together when assembled. The hub 48 in this implementation include three vanes 70 that extend radially-outwardly from a base 66 of the hub 48 into the individual phasing chambers 64. However, it should be appreciated that any number of vanes could be used to implement the hub 48. Pressurized fluid, such as engine oil, can be supplied to one side of the vanes 70 to advance the camshaft 12 and another side of the vanes 70 to retard the camshaft 12. The grooves included in the camshaft sleeve 14 communicate fluid to one side of the vanes 70 for advancing timing and another side for retarding timing. At least one of the vanes 70 includes a locking pin 72 that prevents the hub 48 from rotating relative to the housing 50. A plurality of radially-inwardly extending features 62 define a plurality of chambers 64 that receive fluid for advancing or retarding the camshaft 12. The features 62 extend to abut the base 66 of the hub 48 and permit angular movement of the hub 48 relative to the housing 50 while preventing fluid flow between chambers 64.

Turning back to FIG. 1, the camshaft sprocket 46 can include a plurality of teeth 74 forming a gear on a circumferential surface. The plurality of teeth 74 can be engaged by an endless loop (not shown), such as a chain or a belt, that also engages a crankshaft sprocket (not shown) that transmits rotational energy to the camshaft sprocket 46 and the camshaft 12. The camshaft sprocket 46 also includes an outer or end bearing 76 for the camshaft 12. The surface of the end bearing 76 is annular and extends in an axial direction along the x-axis. The end bearing 76 of the camshaft sprocket 46 rests in the end bearing of the cylinder head of the ICE when the VCT assembly 10 is assembled with the ICE.

The VCT assembly 10 can include one group of elements that move angularly relative to another group of elements. In one implementation, a first group of elements includes the camshaft 12 and the housing 50 whereas a second group of elements includes the camshaft sleeve 14, the hub 48, the thrust plate 52, the camshaft sprocket 46, and the retention device 44. In response to the selective flow of fluid into the advancing or retarding chamber, the first group of elements can be angularly displaced, advanced or retarded, relative to the second group of elements. The camshaft 12 can be securely linked to the housing 50 via a variety of attachment methods, such as using bolts or through welding. And the second group of elements can be assembled around the camshaft sleeve 14. The hub 48 can be slid onto the camshaft sleeve 14 so that a surface of a center aperture 78 of the hub 48 closely conforms to and contacts the outer surface of the camshaft sleeve 14 and an end 80 of the hub 48 abuts the sleeve shoulder 40. The housing 50 can be assembled around the hub 48 and the vanes. The distal bearing section 34 of the camshaft sleeve can be slidably received by the inner cavity 20 of the camshaft 12 so that an outer surface 32 of the camshaft sleeve 14 contacts the inner surface 30 of the inner cavity 20 of the camshaft 12. It should be appreciated that the camshaft sleeve 14 can rotate relative to the camshaft 12. Axial movement between the camshaft sleeve 14 and the camshaft 12 can be prevented by the transition between the smaller and larger diameters within the inner cavity 20 of the camshaft 12, which abuts the transition between the diameter of the distal bearing section 34 and the diameter of the end bearing section 36, and/or the hub 48 abutting the front plate 58. The outer housing 56 and end plate 54 can then be axially slid over the camshaft sleeve 14 to enclose the hub 48. The thrust plate 52 can be axially slid over the camshaft sleeve 14 followed by the camshaft sprocket 46. The retention device 44 can then engage with the securing features 42, in this implementation the hollow bolt engaging the threads of the sleeve 14. As the hollow bolt engages the threads and is torqued to a pre-defined torque value, the hub 48, thrust plate 52, and camshaft sprocket 46 are axially compressed against the sleeve shoulder 40 of the camshaft sleeve 14. An annular flange 82 extending from the thrust plate 52 can provide spacing and clearance between the hub 48 and the housing 50 permitting the hub 48 along with the camshaft sleeve 14, the thrust plate 52, the camshaft sprocket 46, and the retention device 44 to rotate relative to the camshaft 12 and housing 50.

Figure 3:
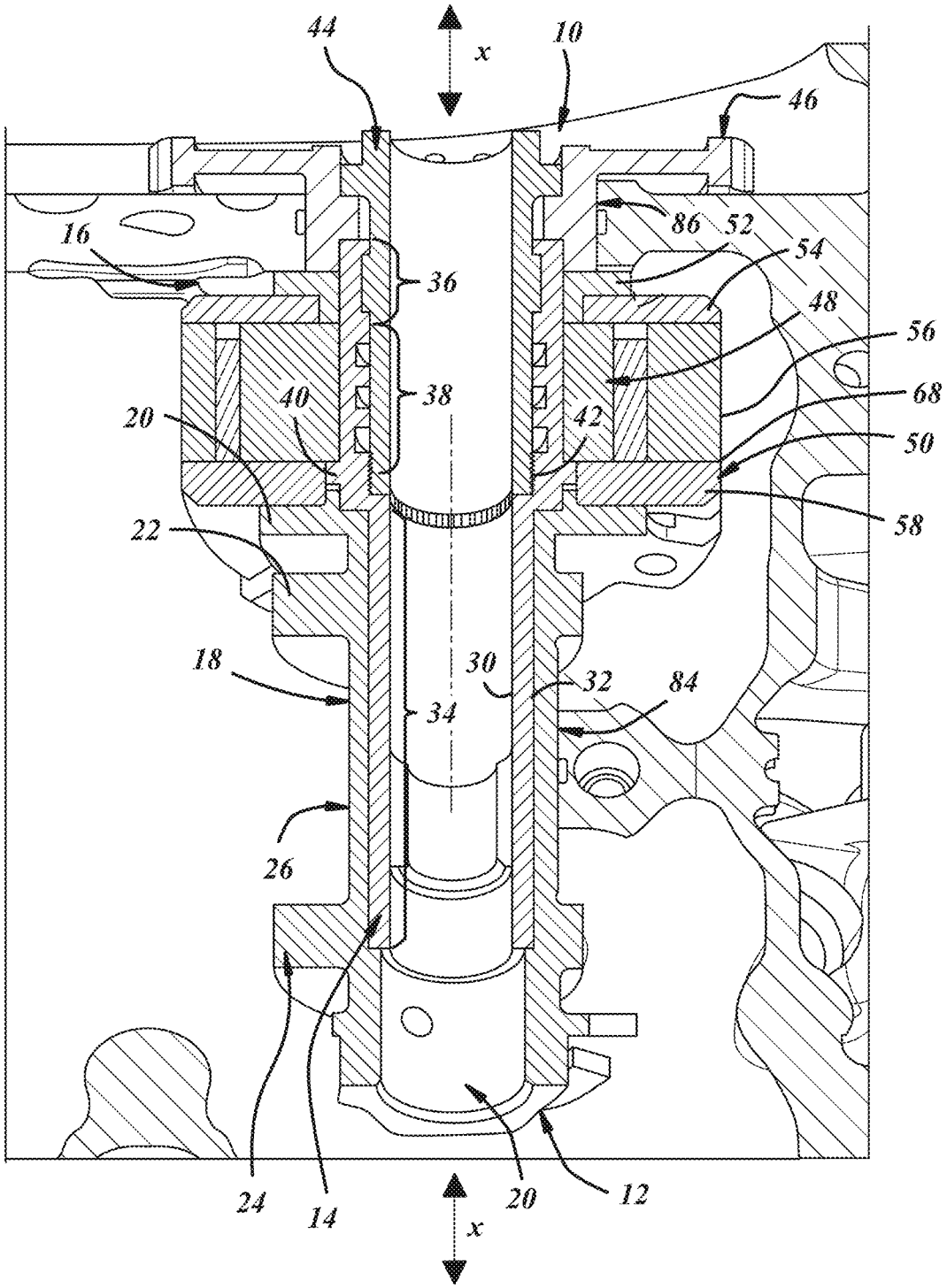
FIG. 3 is a perspective cross-sectional view depicting an implementation of a variable camshaft timing assembly and a camshaft in an internal combustion engine.

The VCT assembly 10 and the camshaft 12 can then be installed in the ICE such that the distal bearing surface 26 of the camshaft 12 rests in a distal bearing 84 of the ICE and the end bearing surface 76 of the camshaft sprocket 46 rests in the end bearing 86 of the ICE. This is shown in FIG. 3 in more detail. The VCT assembly 10 and camshaft 12 are shown in cross-section from a perspective view without the bearing caps installed.

The camshafts combined with the VCT assembly 10 described herein can be removed and reinstalled with without removing the endless loop from the camshaft sprocket or removing the camshaft sprocket from the end bearing. Removing the camshaft can be carried out by removing a cam cover (not shown) to expose the camshafts in the ICE. The retention device can be removed from the camshaft sleeve permitting the camshaft, the housing, the hubbed vanes, and the camshaft sleeve to be moved axially from the camshaft sprocket and lifted away from and out of the ICE. The camshaft sprocket can remain positioned in the end bearing with the endless loop engaging both the crankshaft sprocket and the camshaft sprocket. The removal of the VCT assembly 10 and camshaft from the ICE can be performed to combine a different camshaft with the VCT assembly 10 for installation in the ICE. The ability to leave the camshaft sprocket in the end beating connected to the crankshaft sprocket via the endless loop while removing the camshaft maintains the angular position of the VCT assembly 10 and camshaft relative to the crankshaft during reinstallation without performing a recalibration of timing between the crankshaft and camshaft. Reinstallation of the VCT assembly 10 with a camshaft can involve aligning the camshaft sleeve with the camshaft sprocket via alignment features identifying the proper angular position of the camshaft sleeve relative to the camshaft sprocket, such as a spline engaging a groove or two alignment marks, located on the camshaft sprocket and camshaft sleeve. Once the camshaft sleeve is properly positioned relative to the camshaft sprocket, the retention device can be reinstalled with respect to the camshaft sleeve and torqued to the predefined torque value.

Figure 4:
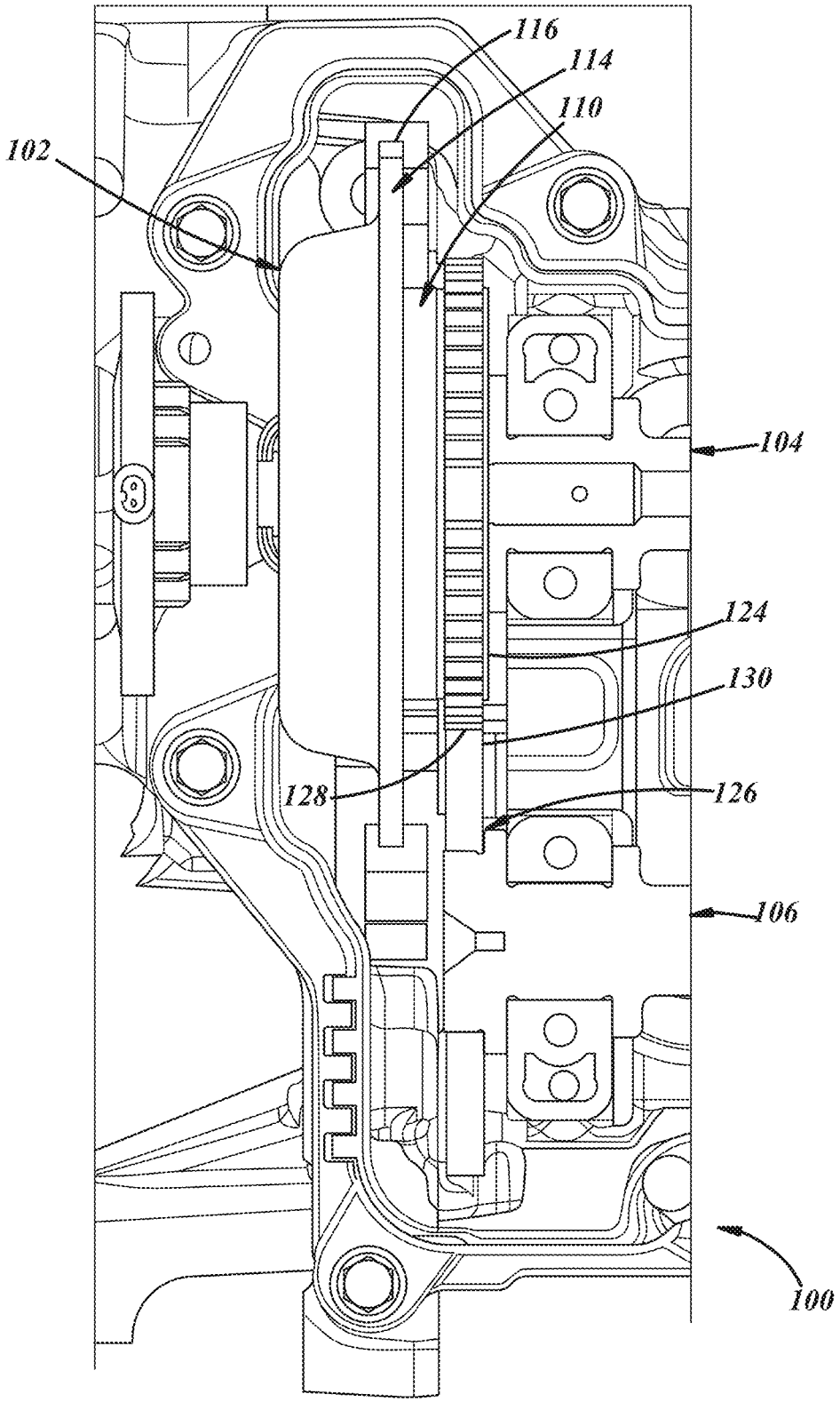
FIG. 4 is a profile view depicting an implementation of a variable camshaft timing assembly shown with two camshafts in an ICE.
Figure 5:
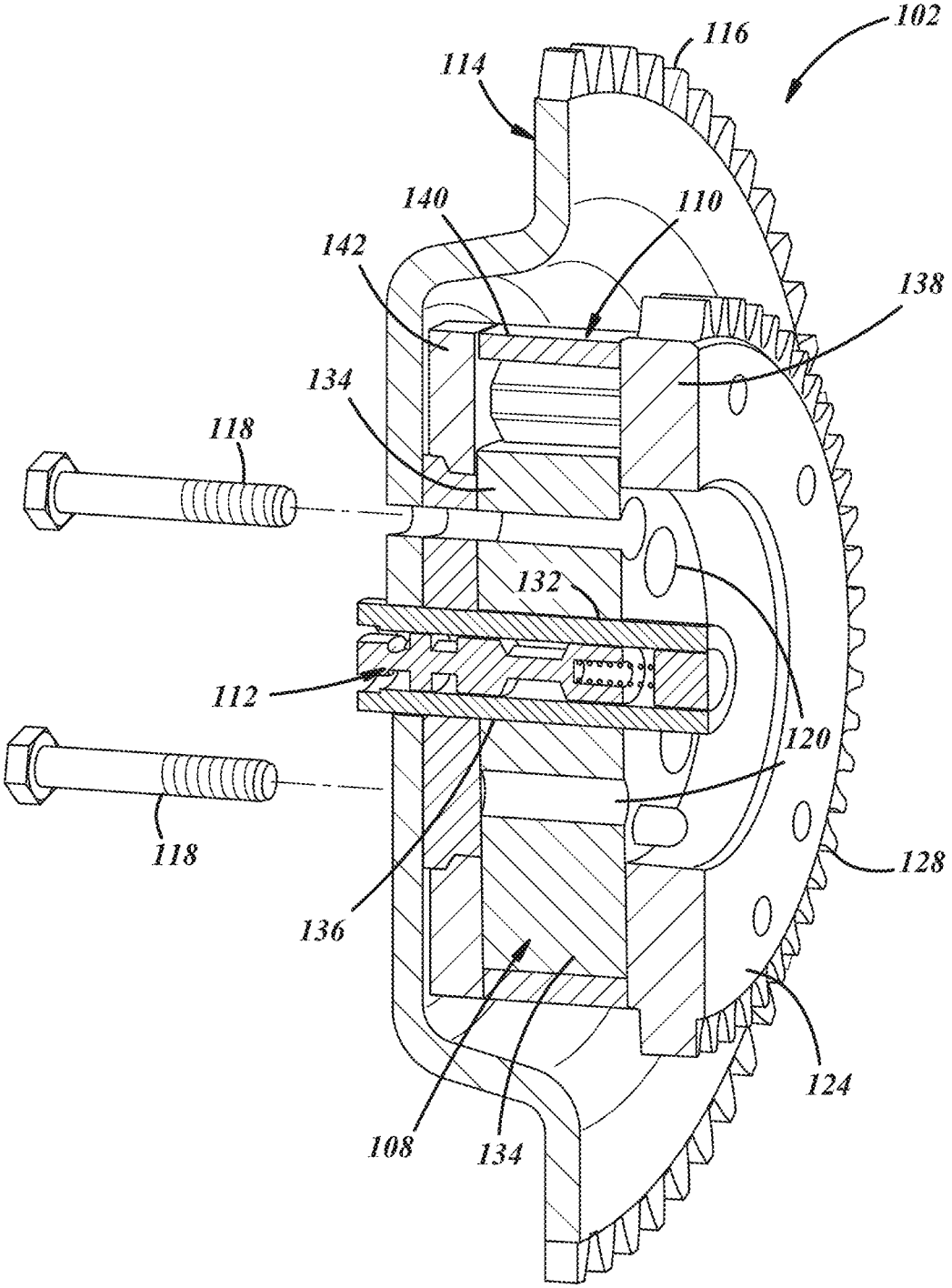
FIG. 5 is a perspective cross-sectional view of an implementation of a hydraulically-actuated camshaft phaser used with a variable camshaft timing assembly.
Figure 6:
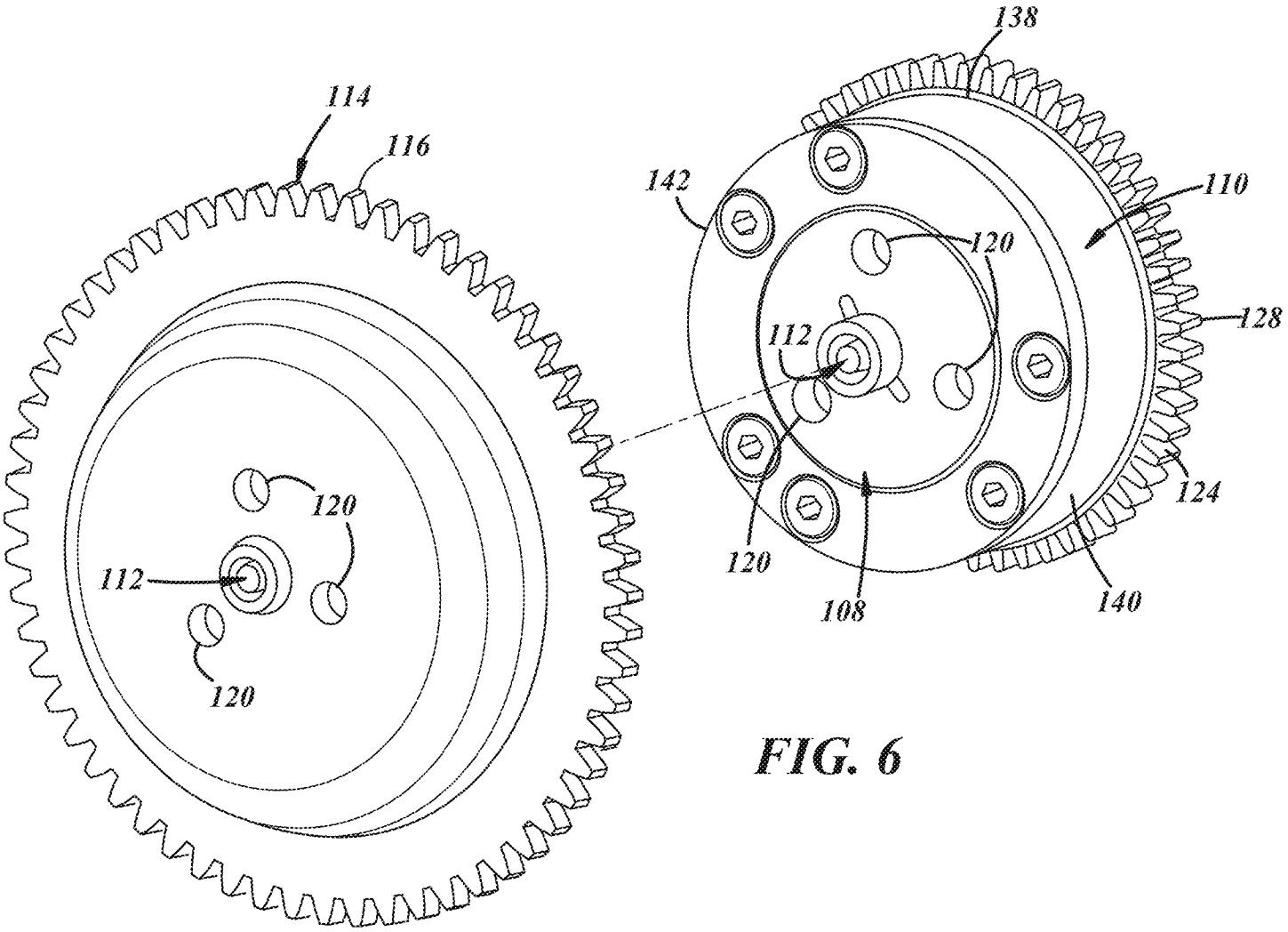
FIG. 6 is a partially exploded view of an implementation of a hydraulically-actuated camshaft phaser used with a variable camshaft timing assembly.

Turning to FIGS. 4-6, another implementation of a VCT assembly 100 used in an internal combustion engine (ICE) is shown having a hydraulically-actuated camshaft phaser 102 that is directly coupled with a fixed phase camshaft 104 and indirectly linked with a variable phase camshaft 106 to change the angular position of the variable phase camshaft 106 with respect to a crankshaft (not shown). The hydraulically-actuated camshaft phaser 102 includes a rotor 108, a housing 110, a spool valve 112 controlling the flow of hydraulic fluid that angularly adjusts the housing 110 relative to the rotor 108, and a camshaft sprocket 114 that is directly coupled with the rotor 108.

The camshaft sprocket 114 includes a plurality of gear teeth 116 extending radially outwardly. An endless loop, such as a chain (not shown), can loop around the gear teeth 116 of the camshaft sprocket 114 and gear teeth of a crankshaft sprocket (not shown) to communicate rotational motion from the crankshaft to the camshaft sprocket 114. The rotor 108, in this implementation, is directly coupled to the camshaft sprocket 114 and a distal end of the fixed phase camshaft 104. Direct coupling can include mechanically fastening the camshaft sprocket 114, the rotor 108, and the fixed phase camshaft 104 so that these elements are not angularly moveable relative to each other, such as could be accomplished with one or more bolts 118. In this implementation, the camshaft sprocket 114, the rotor 108, and the fixed phase camshaft 104 include three mounting receptacles 120 that each receives a threaded bolt 118. Each bolt 118 can pass through the receptacles 120 of the camshaft sprocket 114 and the rotor 108 to be received by threaded receptacles (not shown) in the fixed phase camshaft 104. The bolts 118 can be tightened to a particular torque value to secure the camshaft sprocket 114, the rotor 108, and the fixed phase camshaft 104 together. That is, the camshaft sprocket 114, the rotor 108, and the fixed phase camshaft 104 are angularly fixed relative to each other. The housing 110 can change angular position relative to the rotor 108 and, therefore, change relative angular position relative to the crankshaft.

A phaser output gear 124 can be attached to a radial surface of the housing 110 and be used to indirectly link the fixed-phase camshaft phaser 106 with the variable phase camshaft 106. The phaser output gear 124 can engage a variable phase camshaft sprocket 126 that is coupled to a distal end of the variable phase camshaft 104. The phaser output gear 124 can include a plurality of radially-outwardly facing gear teeth 128 that mesh and mate with gear teeth 130 included on a radially-outwardly facing portion of the variable phase camshaft sprocket 126. As the spool valve 112 directs the flow of hydraulic fluid to change the angular position of the housing HO relative the rotor 1108/crankshaft, the change in relative angular position of the housing 110 relative to the rotor 108/crankshaft can be communicated from the phaser output gear 124 to the variable phase camshaft sprocket 126. While the angular position of the camshaft sprocket 114, the rotor 108, and the fixed phase camshaft 104 are fixed relative to each other, the angular position of the housing 110 is changed relative to the crankshaft. The relative angular movement of the phaser output gear 124 correspondingly moves the variable phase camshaft sprocket 126 a similar angular amount.

The rotor 108 includes a hub 132 with one or more vanes 134 extending radially outwardly from the hub 132. A central aperture 136 of the hub 132 can receive the spool valve 112. An outer surface of the spool valve 112 closely conforms to a surface of the central aperture 136 to selectively direct the flow of fluid to fluid chamber(s) on one side of the vane(s) 134 or to different fluid chamber(s) on another side of the vane(s) 134. The housing 110 can be assembled from an end plate 138, an outer housing 140, and a front plate 142. The end plate 138 can be a flange that forms a portion of the housing 110 but also includes the phaser output gear 124. The variable phase camshaft sprocket 126 can be attached to the variable phase camshaft 106 using a mechanical fastener, such as a bolt that is received by a threaded receiver in the camshaft 106. The variable phase camshaft sprocket 126 is angularly fixed relative to the variable phase camshaft 106 and meshes with the phaser output gear 124. During operation of the ICE, the crankshaft sprocket rotates and transmits that rotation to the camshaft sprocket 114, which communicates this angular motion to both the rotor 108 and the fixed phase camshaft 104. The housing 110 and the phaser output gear 124 rotate along with the hydraulically-actuated camshaft phaser 102. The phaser output gear 124, by virtue of its engagement with the variable phase camshaft sprocket 126, can transmit the angular motion of the crankshaft to the variable phase camshaft 106. Depending on the position of the spool valve 112, the housing 110 can maintain its angular position relative to the rotor 108 and fixed phase camshaft 104 or the housing 110 can change its angular position relative to the rotor 108. A change in angular position of the housing 110 relative to the rotor 108 changes the angular position of the variable phase camshaft 106 relative to the fixed phase camshaft 104 and, therefore, the change in angular position of the housing 110 relative to the angular position of the rotor 108 changes the angular position of the variable phase camshaft 106 relative to the angular position of the crankshaft.

It is to be understood that the foregoing is a description of one or more embodiments of the invention. The invention is not limited to the particular embodiments) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A hydraulically-actuated camshaft phaser, comprising:

a camshaft sprocket having a plurality of teeth configured to engage an endless loop that transmits angular motion from a crankshaft to the hydraulically-actuated camshaft phaser;

a rotor coupled with the camshaft sprocket so as to prevent angular movement between the camshaft sprocket and the rotor, the rotor including one or more vanes extending radially outwardly forming a plurality of fluid chambers;

a housing that selectively changes angular position relative to the rotor and is configured to be directly linked with a variable phase camshaft so as to change an angular position of the variable phase camshaft relative to the crankshaft; and a camshaft sleeve that is configured to couple with a camshaft sprocket and configured to be slidably received by a camshaft.

2. The hydraulically-actuated camshaft phaser recited in claim 1, wherein the housing is directly connected to the variable phase camshaft.

3. The hydraulically-actuated camshaft phaser recited in claim 1, further comprising a phaser output gear coupled with the housing that communicates relative angular displacement between the rotor and the housing to the variable phase camshaft.

4. The hydraulically-actuated camshaft phaser recited in claim 1, further comprising a fixed phase camshaft that is coupled to the rotor and the variable phase camshaft coupled to a variable phase camshaft sprocket, wherein the variable phase camshaft sprocket engages a phaser output gear.

5. The hydraulically-actuated camshaft phaser recited in claim 1, further comprising a spool valve positioned in a center aperture of the rotor and configured to selectively permit a flow of fluid into the plurality of fluid chambers.

6. The hydraulically-actuated camshaft phaser recited in claim 1, wherein the housing comprises an end plate, an outer housing, and a front plate.

7. The hydraulically-actuated camshaft phaser recited in claim 1, wherein the camshaft sleeve further comprises an end bearing section and a distal bearing section.

8. The hydraulically-actuated camshaft phaser recited in claim 7, wherein the camshaft sleeve supports the camshaft at the end bearing section, the distal beating section, or both the end bearing section and the distal bearing section at positions that are radially inward from the camshaft.

9. A hydraulically-actuated camshaft phaser, comprising:

a camshaft sprocket having a plurality of teeth configured to engage an endless loop that transmits angular motion from a crankshaft to the hydraulically-actuated camshaft phaser;

a rotor coupled with the camshaft sprocket so as to prevent angular movement between the camshaft sprocket and the rotor, the rotor including one or more vanes extending radially outwardly forming a plurality of fluid chambers;

a housing that selectively changes angular position relative to the rotor and is configured to indirectly link the housing with a variable phase camshaft so as to change an angular position of the variable phase camshaft relative to the crankshaft; and a camshaft sleeve that is configured to couple with a camshaft sprocket and configured to be slidably received by a camshaft.

10. The hydraulically-actuated camshaft phaser recited in claim 9, further comprising a phaser output gear coupled with the housing that indirectly links the housing with the variable phase camshaft and communicates relative angular displacement between the rotor and the housing to the variable phase camshaft.

11. The hydraulically-actuated camshaft phaser recited in claim 9, further comprising a fixed phase camshaft that is coupled to the rotor and a variable phase camshaft sprocket coupled with the variable phase camshaft, wherein the variable phase camshaft sprocket engages a phaser output gear.

12. The hydraulically-actuated camshaft phaser recited in claim 9, further comprising a spool valve positioned in a center aperture of the rotor and configured to selectively permit a flow of fluid into the plurality of fluid chambers.

13. The hydraulically-actuated camshaft phaser recited in claim 9, wherein the housing comprises an end plate, an outer housing, and a front plate.

14. The hydraulically-actuated camshaft phaser recited in claim 9, wherein the camshaft sleeve further comprises an end bearing section and a distal bearing section.

15. The hydraulically-actuated camshaft phaser recited in claim 14, wherein the camshaft sleeve supports the camshaft at the end bearing section, the distal bearing section, or both the end beating section and the distal bearing section at positions that are radially inward from the camshaft.

* * * * *